United States Patent [19]

Kitai et al.

[11] 4,232,511

[45] Nov. 11, 1980

[54] TIME DETECTING DEVICE FOR A CLOCK

[75] Inventors: Kiyoshi Kitai; Masuo Ogihara, both of Shikawatashi, Japan

[73] Assignee: Seiko Koki Kabushiki Kaisha, Tokyo, Japan

[21] Appl. No.: 935,763

[22] Filed: Aug. 22, 1978

[30] Foreign Application Priority Data

Aug. 29, 1977 [JP] Japan ..... 52/103314
Sep. 7, 1977 [JP] Japan ..... 52/107528

[51] Int. Cl.[3] ..... G04C 21/00

[52] U.S. Cl. ..... 368/73; 368/252; 368/263; 368/259

[58] Field of Search ..... 58/16.5, 16 R, 19 A, 58/19 R, 21.11, 18, 21.155, 125 C, 126 E, 125 B, 16 D, 38 R, 39.5, 13, 39

[56] References Cited

U.S. PATENT DOCUMENTS

| | | | |
|---|---|---|---|
| 2,779,151 | 1/1957 | Fowler | 58/38 |
| 3,210,924 | 10/1965 | Dodd | 58/38 |
| 3,685,280 | 8/1972 | Fehrenbacher | 58/38 |
| 3,686,879 | 8/1972 | Hummel et al. | 58/38 R |
| 3,738,098 | 6/1973 | Scheer | 58/19 R |
| 3,766,728 | 10/1973 | Nagy | 58/38 |
| 3,778,997 | 12/1973 | Jauch | 58/13 |
| 3,807,165 | 4/1974 | Kawada | 58/38 |
| 3,830,053 | 8/1974 | Koide et al. | 58/125 C |
| 3,898,792 | 8/1975 | Insley et al. | 58/39.5 |
| 3,996,734 | 12/1976 | Kitai et al. | 58/19 A |
| 4,060,972 | 12/1977 | Kimura et al. | 58/16 D |
| 4,070,822 | 1/1978 | Arai | 58/16 D |

*Primary Examiner*—J. V. Truhe
*Assistant Examiner*—Forester W. Isen
*Attorney, Agent, or Firm*—Robert E. Burns; Emmanuel J. Lobato; Bruce L. Adams

[57] ABSTRACT

A stationary detecting means corresponding to a second time wheel rotating at a higher speed than the hour wheel generates signals at successive intervals of a fixed number of minutes to actuate a time signaling device. A first detecting means is also provided corresponding to the hour wheel. The phase of the first detecting means is set to determine or define an alarm or signaling time. When the phases of the hour wheel and the first detecting means are synchronized, a second signal is generated. The time signaling device is actuated when the time signals of the stationary detecting means and the second detecting means are generated simultaneously.

6 Claims, 6 Drawing Figures

TIME DETECTING DEVICE FOR A CLOCK

BACKGROUND OF THE INVENTION

This invention relates to a time detecting device for a time signaling clock or an alarm clock, and more particularly it relates to a precision time detecting device.

It is the usual method of the conventional time detecting device to detect the signaling time by means of a clock hour wheel, however, the precision of the signaling time detection by the conventional method is not satisfactory.

In order to improve the accuracy of signaling time detection, a dual signaling time detecting means comprising a detecting means employing the minute wheel in addition to a detecting means employing the hour wheel has been introduced, in which dual signaling time detecting means the time signaling device is actuated only when both detecting means have detected the signaling time simultaneously. However, the alarm clock provided with this dual signaling time detecting means has both a cost and dimensional disadvantage in that the construction is complicated because both the hour and the minute detecting means require individual parts for constructing the detecting means.

In the case of a time indicating leaf type digital time signaling clock or a digital alarm clock, an error in signaling time detection by means of the minute wheel causes discrepancy between the time indication by the time indicating leaves and actual signaling time.

A general object of the present invention is to overcome those abovementioned disadvantages of the conventional time detecting means.

SUMMARY OF THE INVENTION

According to the method of the present invention, the detecting device is constructed of a first detecting means comprising a detecting plate provided corresponding to the hour wheel and adjusted according to alarm signaling time setting operation, and a second detecting means generating detection signals at an interval of a fixed number of fixed minutes, independently of the alarm signaling time, according to the rotation of a second time wheel rotating at a higher speed than the hour wheel. In the case of a time indicating leaf type clock, a detecting means is provided corresponding to projections of some of the minute indicating leaves.

BRIEF DESCRIPTION OF THE DRAWINGS

Other objects and advantages will become more fully apparent as reference is had to the accompanying drawings, wherein the invention is illustrated and in which.

DESCRIPTION OF THE PREFERRED EMBODIMENTS

Figure 1:
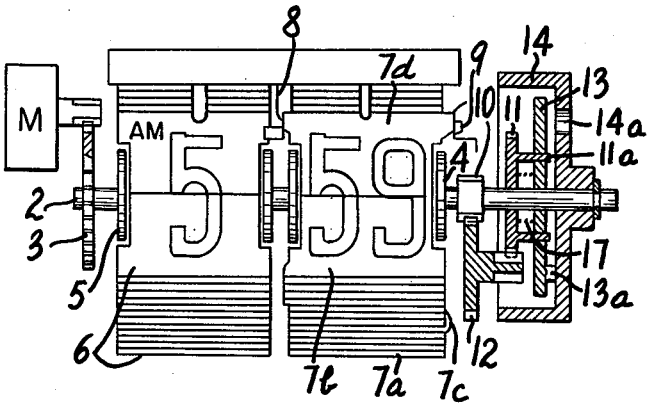
FIG. 1 is a plan view of a first embodiment of this invention.
Figure 2:
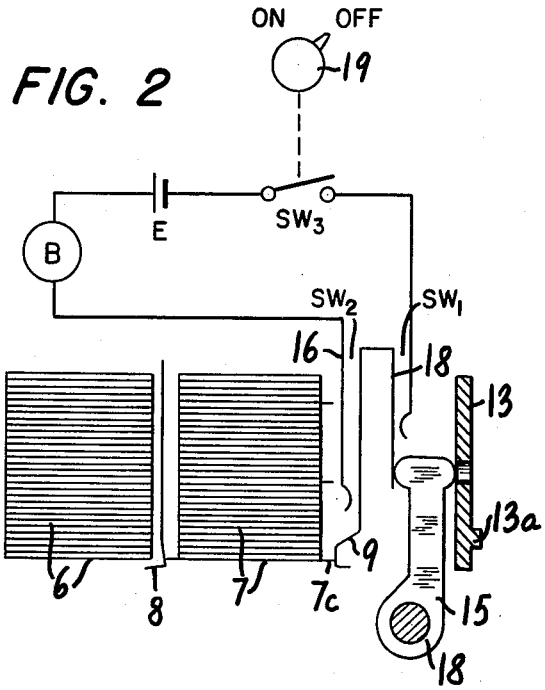
FIG. 2 is a schematic drawing of FIG. 1.
Figure 3:
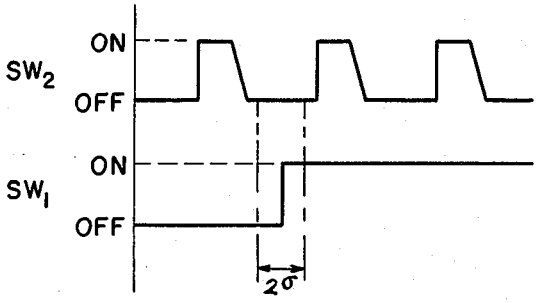
FIG. 3 is an operational diagram illustrating signal waveforms developed during operation of the device of FIG. 1.

Referring to FIGS. 1 to 3 inclusive, explanation will be made on the construction of the first embodiment.

A driving motor (1) drives the minute wheel (3) fixed on a rotatable shaft (2). Fixed on the shaft (2) is a minute leaf drum (4) having a plurality of minute leaves. Rotatably fitted on the shaft (2) is an hour leaf drum (5) having a plurality of hour leaves (6) and driven by the minute wheel (3) through a well known gear train (not shown) at a constant rate. The set of the minute leaves comprises first minute leaves (7*a*) having no projection, second minute leaves (7*b*) each having a projection on the left edge, third minute leaves (7*c*) each having a projection on the right edge, and fourth minute leaves (7*d*) each having projections on the right and left edges.

The projections of the second minute leaves (7*b*) and the fourth minute leaves (7*d*) are linked to an hour leaves retaining spring (8) so as to turn over an hour leaf (6) when a minute leaf (7*b*) turns over from 59 minute to 00 minute.

The third minute leaves (7*c*) are arranged every 10 leaves. A detecting spring (9) is linked to the projections of the third leaves (7*c*) and the fourth leaves (7*d*).

A minute hand pinion (10) fixed on the shaft (2) is engaged with a second intermediate hour wheel (12) engaging with a second hour hand wheel (11) rotatably mounted on the shaft (2). A detecting plate (13) is slidable on the shaft (2) in the axial direction guided by a pair of pins (11*a*) fixed to the second hour hand wheel (11).

The detecting plate (13) is provided with a cam (13*a*) on the right face. An alarm signaling time setting wheel (14) rotatable about the shaft (2) is provided with a well known click-stop motion (not shown) so as to click-stop at an interval, for instance every 10 minutes' indication. A hole (14*a*) is provided on the alarm signaling time setting wheel (14). The hole (14*a*) allows the detecting plate (13) to shift right-wards pushed by a spring (17) when the phases or relative positions of the hole (14*a*) and the cam (13*a*) are synchronized at the alarm signaling time.

Referring to FIG. 2, an end of a detecting lever (15) rotatably mounted on a shaft (18) is in contact with both the detecting plate (13) and a contact piece (18) of a normally closed first detecting switch (SW1) and normally forced clockwise by the contact piece (18).

The detecting spring (9) and a stationary contact piece (16) correspondingly constitute a second detecting switch (SW2).

A manual switch (SW3) is operated by an alarm stopping button (19). One terminal of a buzzer (B) is connected to the positive terminal of the battery (E) and the other terminal of which is connected to the negative terminal of the battery (E) through the second detecting switch (SW2), the first detecting switch (SW1) and the manual switch (SW3).

Explanation will be made hereinafter of the operation of the mechanism described above.

First, the manual switch (SW3) is closed by setting the alarm stopping button (19) to the ON-position, and then the alarm signaling time is set by turning the alarm signaling time setting wheel (14).

The first detecting switch (SW1) remains open until the cam (13*a*) of the detecting plate plunges into the hole (14*a*) of the alarm signaling time setting wheel (14).

As time passes, the drums (4 and 5) are driven by the motor (M) so that the minute leaves are turned over one by one according to the rotation of the drums. The detecting spring (9) is actuated by the projections on the right side edges of the third leaves (*7c*) or the fourth leaves (*7d*) so that the second detecting switch (SW2) is closed and opened every 10 minutes alternately. As shown in FIG. 3 diagrammatically showing the switching operation of the second detecting switch (SW2), the second detecting switch (SW2) is kept open for about 6 minutes while the detecting spring (9) is engaged with the projection of the third or fourth minute leaf (*7c* or *7d*) and the second detecting switch is closed when the detecting spring (9) is released. The second detecting switch (SW2) remains closed for about 3 minutes.

Although the second detecting switch (SW2) is closed periodically, the buzzer (B) will not be actuated until the first detecting switch is closed simultaneously. At the alarm signaling time, in the first place, the phases of the detecting cam (13*a*) and the hole (14*a*) of the alarm signaling time setting wheel coincide to allow the detecting plate (13) to shift rightward so that the first detecting switch (SW1) closes automatically. Although closing timing of the first detecting switch (SW1) fluctuates within the range of $\pm\tau$, the buzzer (B) will not be actuated within this range of fluctuation as the second detecting switch system is so designed that the second detecting switch (SW2) is not closed within this range of fluctuation.

As time passes as the first detecting switch (SW1) closed, the second detecting switch (SW2) is closed when the third or fourth minute leaf (*7c* or *7d*) is turned over and consequently, the buzzer (B) is actuated. The buzzer (B) repeats buzzing in accordance with switching-on and off of the second detecting switch (SW2) until the phase of the cam (13*a*) has been advanced according to the rotation of the detecting plate (13) relative to the phase of the hole (14*a*) and the detecting plate (13) has been shifted leftward.

The buzzing may be optionally interrupted by opening the manual switch (SW3) by setting the alarm stopping button (19) to the OFF-position.

Figure 4:
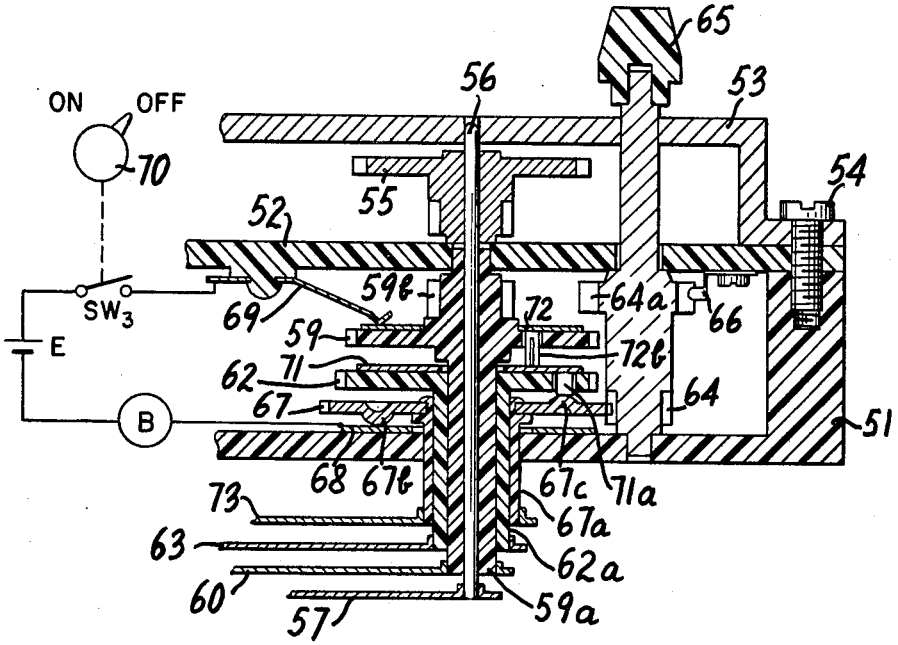
FIG. 4 is a sectional view of a second embodiment of this invention.
Figure 5:
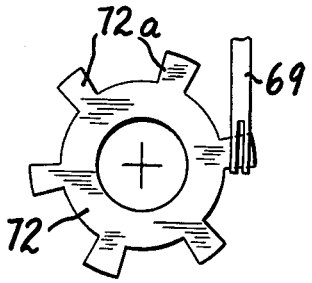
FIG. 5 is a partial plan view of the device of FIG. 4.

Referring to FIGS. 4 and 5, explanation will be made of the second embodiment.

A middle plate (52) and a cover plate (53) are fixed to a case (51) by means of screws (54).

The case (51) rotatably retains the tubular boss (67*a*) of a detecting wheel (67) and the alarm signaling time setting wheel (64). The middle plate (52) rotatably retains the minute wheel (59). The cover plate (53) rotatably retains the shaft (56) of the second wheel (55) and the alarm signaling time setting wheel (64). The construction of the gear train for the time indicating system will be explained hereinafter. A motor (not shown) drives the second wheel (55), and on the tip of the second wheel shaft (56) is fixed the second hand (57).

The second wheel (55) is engaged with the minute wheel (59) through an intermediate wheel (not shown) having a frictional coupling mechanism commonly used. The minute wheel (59), the tubular boss (59*a*) and the pinion (59*b*) are made of a plastic material in a body. The minute hand (60) is fixed on the tip of the tubular boss (59*a*). The pinion (59*b*) is engaged with the hour wheel (62) through an intermediate hour wheel (not shown). The hour wheel (62) and the tubular boss (62*a*) are made of a plastic material in a body. The hour hand (63) is fixed on the tip of the tubular boss (62*a*).

Explanation will be made hereinafter on the alarm signaling mechanism.

The tubular boss (67*a*) fixedly provided with an indicator (73) on its tip is fastened to the detecting wheel (67), made of an electrically conductive material by caulking. The alarm signaling time setting wheel (64) is engaged with the detecting wheel (67). A knob (65) is fixed on one end of the shaft of the alarm signaling time setting wheel (67). And a click-stop wheel (64*a*) is formed in a body at the middle of the shaft.

A click-stop spring (66) engaged with the click-stop wheel (64*a*) is fixed to the middle plate (52). The alarm signaling time setting wheel is click-stopped at every position step corresponding to a fixed period of time, for instance 10 minutes.

One end of a first stationary contact plate (68) fixed on the case (51) is connected to the negative terminal of the battery (E) through the buzzer (B). The second stationary contact plate (69) fixed on the middle plate (52) is connected to the positive terminal of the battery (E) through a manual switch (SW3). An alarm stopping button (70) for switching-on and off the manual switch (SW3) is selectively set to the ON and OFF position.

The detecting wheel (67) is provided with three first projections (67*b*) and a second projection (67*c*) on its bottom and upper face, respectively. The first projections (67*b*) are always in electric contact with the first stationary contact plate (68).

A protrusion (71*a*) of the hour switch plate (71) fixed on the hour wheel (62) extends downwards through the hour wheel (62) so that the tip is positioned almost in the plane of the bottom face of the hour hand wheel (62).

The second projection (67*c*) and the protrusion (71*a*) of the hour switch plate come in electric contact once every 12 hours according to the rotation of the hour wheel (62) driven by the motor.

A minute switch plate (72) fixed on the minute wheel (59) is provided with radial contact arms (72*a*), as shown in FIG. 5, and a sliding contact piece (72*b*) which is always in sliding contact with the hour switch plate (71). Accordingly, the minute switch plate (72) and the hour switch plate (71) are always electrically connected and the minute switch plate (72) and the second stationary contact piece (69) are electrically connected and disconnected alternately as the switching motion of the (SW2) shown in FIG. 3 according to the rotation of the minute wheel (59).

Following is an explanation of the operation of the mechanism described above.

In the first place, a selected alarm signaling time is set by turning the knob (65) so that the phase of the second projection (67*c*) of the detecting wheel (67) is determined. Secondly, the alarm stopping button (70) is set to the ON-position to close the manual switch (SW3).

Although the minute switch plate (72) and the second stationary contact plate (69) are electrically connected six times every one hour according to the rotation of the minute switch plate (72) by the electric contact of the radial contact arms (72*a*) with the second stationary contact plate (69), the buzzer will not be actuated yet until the second projection (67*c*) of the detecting wheel (67) comes in contact with the protrusion (71*a*) of the hour switch plate. With the approach of the alarm signaling time, first the phases of the protrusion (71*a*) of the hour switch plate and the second projection (67*c*) of the detecting wheel are synchronized so that the hour switch plate and the detecting wheel are electrically connected. At this moment, the buzzer will not be actuated yet as in the case of the first embodiment because the radial contact arms (72*a*) of the minute switch plate and the second stationary contact plate (69) are designed so as not to come in contact before the alarm signaling time.

At the alarm signaling time, the radial contact arm (72*a*) of the minute switch plate and the second stationary contact plate come in contact with each other.

Consequently, the electric circuit, the first stationary contact plate (68)—detecting wheel (67)—the hour switch plate (71)—the minute switch plate (72)—the second stationary contact plate (69), is closed and the buzzer is actuated. The buzzer repeats buzzing in accordance with the rotation of the minute wheel (59) as in the case of the first embodiment until the manual switch (SW3) is opened by operation of the alarm stopping button (70).

In the second embodiment, radial contact arms (72*a*) are provided for the minute switch plate (72), but in a modification, the radial contact arms may be provided for the second stationary contact plate corresponding to a slide contact piece provided on the minute switch plate.

The sliding contact detecting method of the second embodiment may be applicable to the first embodiment wherein the detecting signal is generated by mechanical displacement of the detecting spring while the detecting method of the first embodiment is applicable to the second embodiment by providing projections to the minute hand wheel corresponding to the detecting spring.

Figure 6:
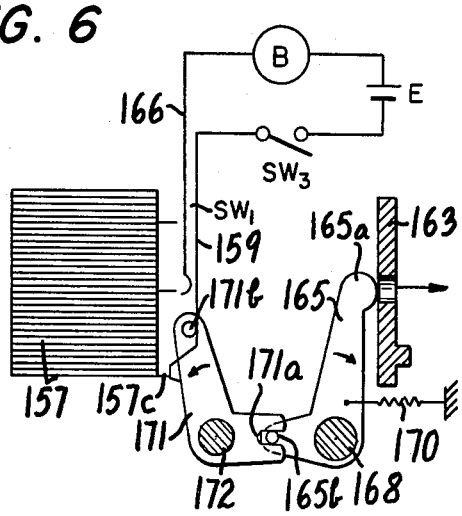
FIG. 6 is a schematic illustration of a third embodiment of this invention.

Referring to FIG. 6, explanation will be made of the third embodiment.

The construction of the third embodiment is identical with that of the first embodiment except the construction of the detecting switch.

First, second, third and fourth minute indicating leaves (157*a*, 157*b*, 156*c* and 157*d*, respectively) are identical with the minute indicating leaves of the first embodiment.

A detecting spring (159) is disposed so as to be engaged with the projections of the third and fourth minute indicating leaves (157*c* and 157*d*). The detecting spring (159) and a stationary contact plate (166) constitute a detecting switch (SW1).

The detecting plate (163) made similarly to that of the first embodiment and is shifted rightwards at the alarm signaling time.

One end (165*a*) of a first detecting lever (165) rotatable about the shaft (168) and forced clockwise by a spring (170) is always in contact with the detecting plate (163) and the other end is provided with a pin (165*b*).

A second detecting lever (171) rotatable about the shaft (172) has on its one end a slot (171*a*) receiving the pin (165*b*) and on the other end a pin (171*b*) engaging with the detecting spring (159). The detecting switch (SW1) will not be closed until the detecting plate (153) has shifted rightwards if the detecting spring (159) is released from the projection of the minute indicating leaf (157*c* or 157*d*) as the detecting spring (159) is retained by the pin (171*b*).

A manual switch (SW3) functions similarly to that of the first embodiment. One terminal of the buzzer (B) is connected to the positive terminal of the battery (E) and the other terminal of the buzzer is connected to the negative terminal of the battery (E) through the detecting switch (SW1) and the manual switch (SW3).

Following is an explanation of the operation of the mechanism described above.

The detecting spring (159) of the detecting switch (SW1) is retained by the pin (171*b*) of the second detecting lever (171) to keep the detecting switch (SW1) open until the predetermined alarm signaling time. As the alarm signaling time approaches, the detecting plate (163) becomes free to shift rightwards, consequently, the pin (171*b*) releases the detecting spring (159) in response to the clockwise rotation of the first detecting lever (165) and the counterclockwise rotation of the second detecting lever (171). However the buzzer (B) will not be actuated yet at this moment as the detecting switch (SW1) is designed not to be closed by the engagement of the detecting spring (159) with the projection of the third or fourth minute indicating leaf (157*c* or 157*d*) before the precise alarm signaling time as in the case of the first embodiment.

At the alarm signaling time, when the minute indicating leaf (157*c* or 157*d*) turns over, the detecting spring (159) is released from the projection of the minute indicating leaf so that the detecting switch (SW1) is closed to actuate the buzzer (B).

The buzzing is repeated in accordance with the closing and opening of the detecting switch (SW1) performed by the engagement and disengagement of the detecting spring (159) with the projections of the third or fourth minute indicating leaves (157*c* or 157*d*) until the detecting plate (163) is shifted leftwards, provided that the manual switch (SW3) remains closed.

Although the invention has been described in its application to alarm clocks, it may be applied to a time signaling clock which interrupts time signals every hour by eliminating the time detecting mechanism for the hour wheel and arranging the minute detecting switch so as to be closed only when the minute indicating leaves turn over from 59 minute to 00 minute.

In the preferred embodiments, having described the detecting spring with an independent function in order that the mechanism of this invention may be clearly understood, in a modified form, the hour indicating leaf retaining spring may be used as the detecting spring by providing a stationary contact piece corresponding to the hour indicating leaf retaining spring.

We claim:

1. In a clock of the type which includes a rotating hour wheel having an angular position representative of the hour, a second rotating time wheel which rotates at a higher speed than the hour wheel and which has an angular position representative of a time interval less than one hour, time indicating leaves retained on said second time wheel and indicating time digitally, the improvement comprising a time signaling device for signaling when a predetermined time occurs, said time signaling device comprising: first detecting means for detecting when the hour wheel is at an angular position corresponding to the predetermined time; second detecting means for detecting when the second time wheel is at an angular position corresponding to the predetermined time and for thereafter successively detecting when predetermined time intervals occur during the hour following the detection of the predetermined time; said time indicating leaves having projections; and said second detecting means detecting one of said projections to determine the angular position of said second time wheel.

2. In a digital leaf clock having a plurality of hour leaves for indicating hours, and a plurality of minute leaves for indicating minutes, wherein ones of said minute leaves have projections for engaging and controlling exposure of the hour leaves as time advances, the improvement comprising: second projections on selected ones of said minute leaves spaced at regular intervals and independent of the first mentioned projections, and detecting means cooperative with said second projections for detecting at regular time intervals when the selected ones of said minute leaves are exposed for viewing.

3. In a clock according to claim 2, said time detecting means comprises a detecting spring engaging with said second projections, and a stationary contact piece to make electrical contact with said detecting spring in response to said second projections engaging said detecting spring.

4. In an alarm clock of the type which includes an alarm mechanism for sounding an alarm at a settable alarm time, the combination comprising: an alarm time setting member positionable for setting the alarm time; a rotating hour wheel; a second rotating time wheel which rotates at a higher speed than said hour wheel; first detecting means comprised of a detecting wheel angularly positionable relative to said hour wheel for producing a first alarm signal just before the set alarm time, wherein said alarm time setting member includes means for rotating said detecting wheel to set the alarm time; second detecting means unaffected by setting of the alarm time for producing a second alarm signal at predetermined time intervals in response to rotation of said second time wheel; and alarm means responsive to the first and second alarm signals for sounding an audible alarm signal, whereby said alarm means is operated by the second alarm signal which is produced just before the first alarm signal is produced, and by the first alarm signal, and thereafter at intervals determined by the second alarm signal as long as the first alarm signal is produced.

5. In an alarm clock according to claim 4, wherein said combination further comprises: time indicating leaves retained on said hour wheel and time indicating leaves retained on said second time wheel for indicating time digitally; said time indicating leaves on said second time wheel including first leaves having projections extending therefrom and second leaves not having projections, wherein said first and second leaves are mutually arranged at regular intervals; and said second detecting means coacting with said projections of said first leaves for producing said second alarm signal.

6. In a digital leaf clock having a signaling device, a plurality of hour leaves for indicating hours, and a plurality of minute leaves for indicating minutes, wherein ones of said minute leaves having projections for engaging and controlling exposure of the hour leaves as time advances, the improvement comprising; second projections on selected ones of said minute leaves spaced at regular intervals and independent of first mentioned projections, and detecting means cooperative with said second projections for detecting and operating said signaling device at regular time intervals when the selected ones of said minute leaves are exposed for viewing.

* * * * *